US012498197B2

(12) United States Patent
Zimmer

(10) Patent No.: US 12,498,197 B2
(45) Date of Patent: Dec. 16, 2025

(54) SLING SYSTEM USED TO CARRY AND CONCEAL A FIREARM

(71) Applicant: Trent Zimmer, Youngsville, LA (US)

(72) Inventor: Trent Zimmer, Youngsville, LA (US)

(73) Assignee: UNITY Tactical, LLC, Broussard, LA (US)

( * ) Notice: Subject to any disclaimer, the term of this patent is extended or adjusted under 35 U.S.C. 154(b) by 0 days.

(21) Appl. No.: 18/079,642

(22) Filed: Dec. 12, 2022

(65) Prior Publication Data

US 2023/0184511 A1 Jun. 15, 2023

Related U.S. Application Data

(60) Provisional application No. 63/288,713, filed on Dec. 13, 2021.

(51) Int. Cl.
*F41C 33/06* (2006.01)
*F41C 33/00* (2006.01)

(52) U.S. Cl.
CPC ..... *F41C 33/002* (2013.01); *F41C 33/06* (2013.01)

(58) Field of Classification Search
CPC ..... F41C 33/002; F41C 33/00; F41C 33/06; Y10S 224/913; Y10S 224/916; F41B 5/1457; F41B 5/1461; A45F 2200/0591
USPC ..... 224/150
See application file for complete search history.

(56) References Cited

U.S. PATENT DOCUMENTS 4,756,456 A * 7/1988 Schauer ..... F41C 33/06 224/614
5,143,266 A * 9/1992 Heckerman ..... F41C 33/002 224/264
2008/0110076 A1* 5/2008 Bennett ..... F41C 33/06 42/96

* cited by examiner

*Primary Examiner* — Adam J Waggenspack
(74) *Attorney, Agent, or Firm* — Asgaard Patent Services, LLC; F. Wayne Thompson, Jr.

(57) ABSTRACT

Disclosed is a sling system comprising a sling used to carry a firearm, a bag used to conceal the firearm attached to the sling, and a release device used to releasably attach the bag to the sling. In this way, a user can discreetly transport the firearm while maintaining the ability to rapidly deploy the firearm by simply detaching the bag concealing it.

20 Claims, 11 Drawing Sheets

SLING SYSTEM USED TO CARRY AND CONCEAL A FIREARM

CROSS-REFERENCE TO RELATED APPLICATION(S)

This application claims the benefit of U.S. Provisional Application Ser. No. 63/288,713, filed on Dec. 13, 2021, the entirety of which is incorporated herein by reference.

TECHNICAL FIELD

This disclosure relates to implementations of a sling system used to carry and conceal a firearm. In particular, the present disclosure is directed to implementations of a sling system comprising a sling used to carry a firearm and a detachable bag used to conceal the firearm attached to the sling.

BACKGROUND

Purpose built bags used to discreetly carry and provide quick access to a firearm, such as a rifle or a handgun, are well known in the prior art. These discreet carry bags, sometimes referred to as "concealed carry bags" or "everyday carry bags", are designed to be discrete by not looking like a traditional firearm case or bag and include a storage compartment for a firearm.

Due to the increased popularity of PDW-style firearms, discrete carry bags that include a storage compartment configured to receive a PDW-style firearm are gaining popularity. PDW-style firearms are not typically compatible with conventional holster designs. As such, the storage compartment acts as a sheath for the PDW-style firearm.

Accordingly, needs exist for the sling system disclosed herein. It is to the provision of a sling system configured to address these needs, and others, that the present invention is primarily directed.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a sling system comprising a sling used to carry a firearm, a bag used to conceal the firearm attached to the sling, and a release device used to releasably attach the bag to the sling. In this way, a user can discreetly transport the firearm while maintaining the ability to rapidly deploy the firearm by simply detaching the bag concealing it.

An example sling system includes a sling, a bag, and a release device. The sling has a strap with a first end and a second end opposite the first end. The strap includes a first aperture adjacent the first end and a second aperture adjacent the second end. The bag has a storage compartment including a first connection loop and a second connection loop positioned and configured to extend through the first aperture and the second aperture, respectively. The release device includes a pull tab and an elongate cable having a first end portion and a second end portion. The first end portion and the second end portion are configured to work in conjunction with the first connection loop and the second connection loop, respectively, to releasably attach the bag to the sling.

Another example sling system includes a firearm sling, a bag, a first connection loop, a second connection loop, and a release device. The bag includes a firearm storage compartment. The first and second connection loops are positioned within the firearm storage compartment. The release device is configured to work in conjunction with the first and second connection loops to attach the bag to the firearm sling, and is further configured to detach the bag from the firearm sling when pulled.

Yet another example sling system includes a firearm sling, a firearm bag, a first adapter panel, a second adapter panel, and a release device. The firearm bag includes a storage compartment. The release device is configured to releasably attach the firearm bag to the firearm sling. The first and second adapter panels are positioned within the storage compartment of the firearm bag and configured to work in conjunction with the release device to releasably attach the firearm bag to the firearm sling. The release device is also configured to detach the firearm bag from the firearm sling when pulled.

BRIEF DESCRIPTION OF THE DRAWINGS

Like reference numerals refer to corresponding parts throughout the several views of the drawings.

DETAILED DESCRIPTION

Figure 5:
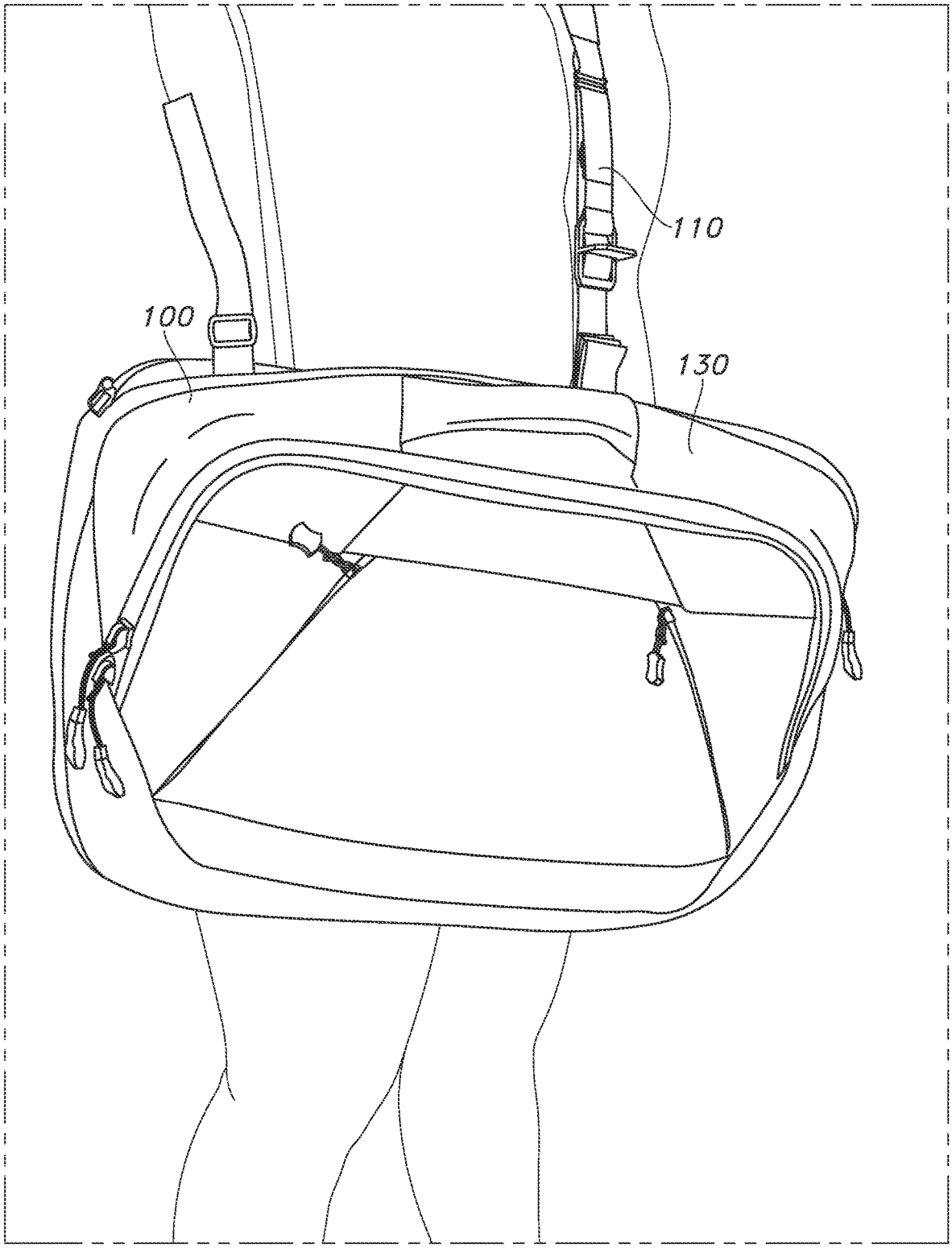
FIG. 5 is a side view of the sling system shown in FIG. 1 in use.
Figure 6:
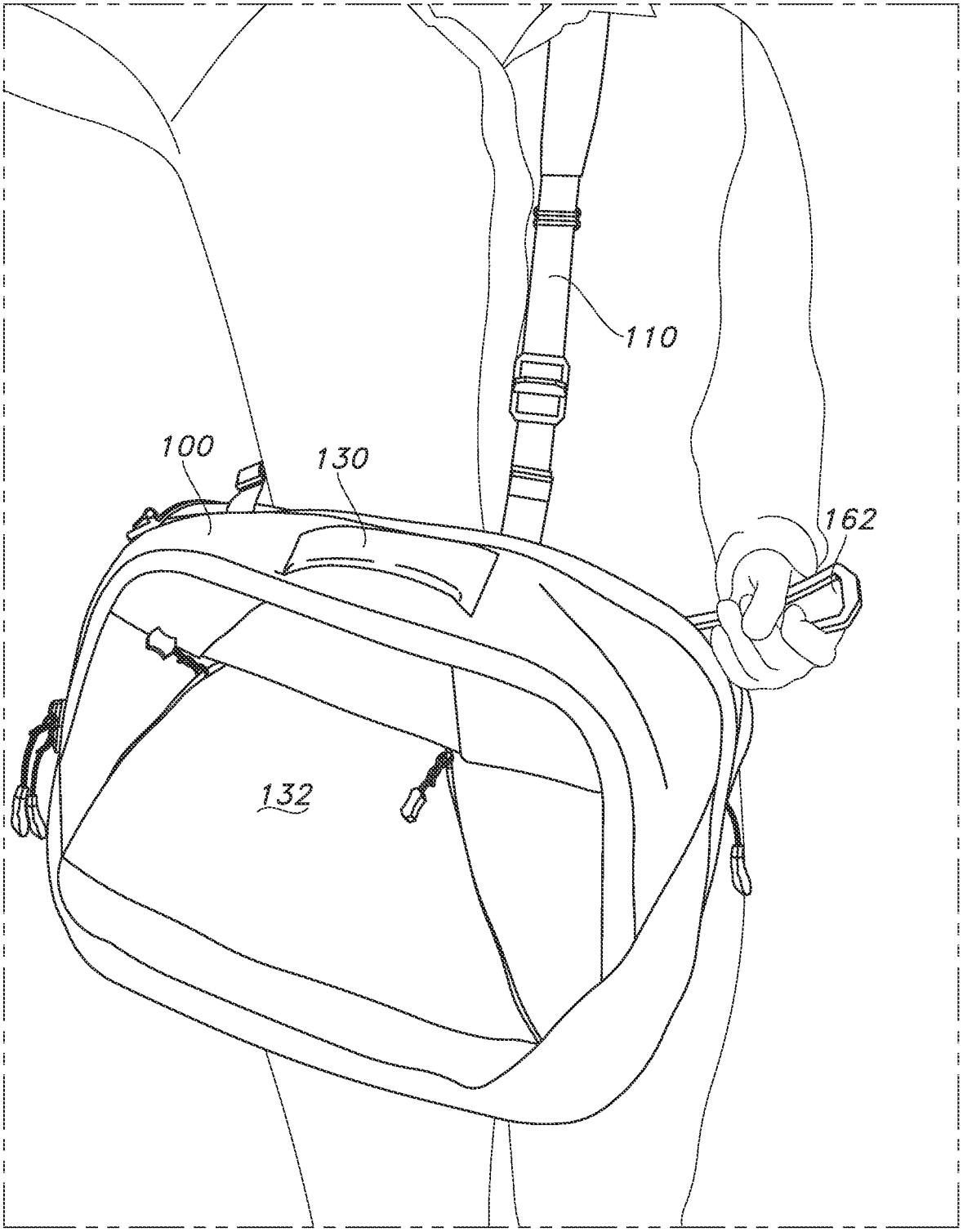
FIG. 6 is another side view of the sling system shown in FIG. 1 in use, wherein the user is shown grasping the pull tab of the release device.
Figure 7:
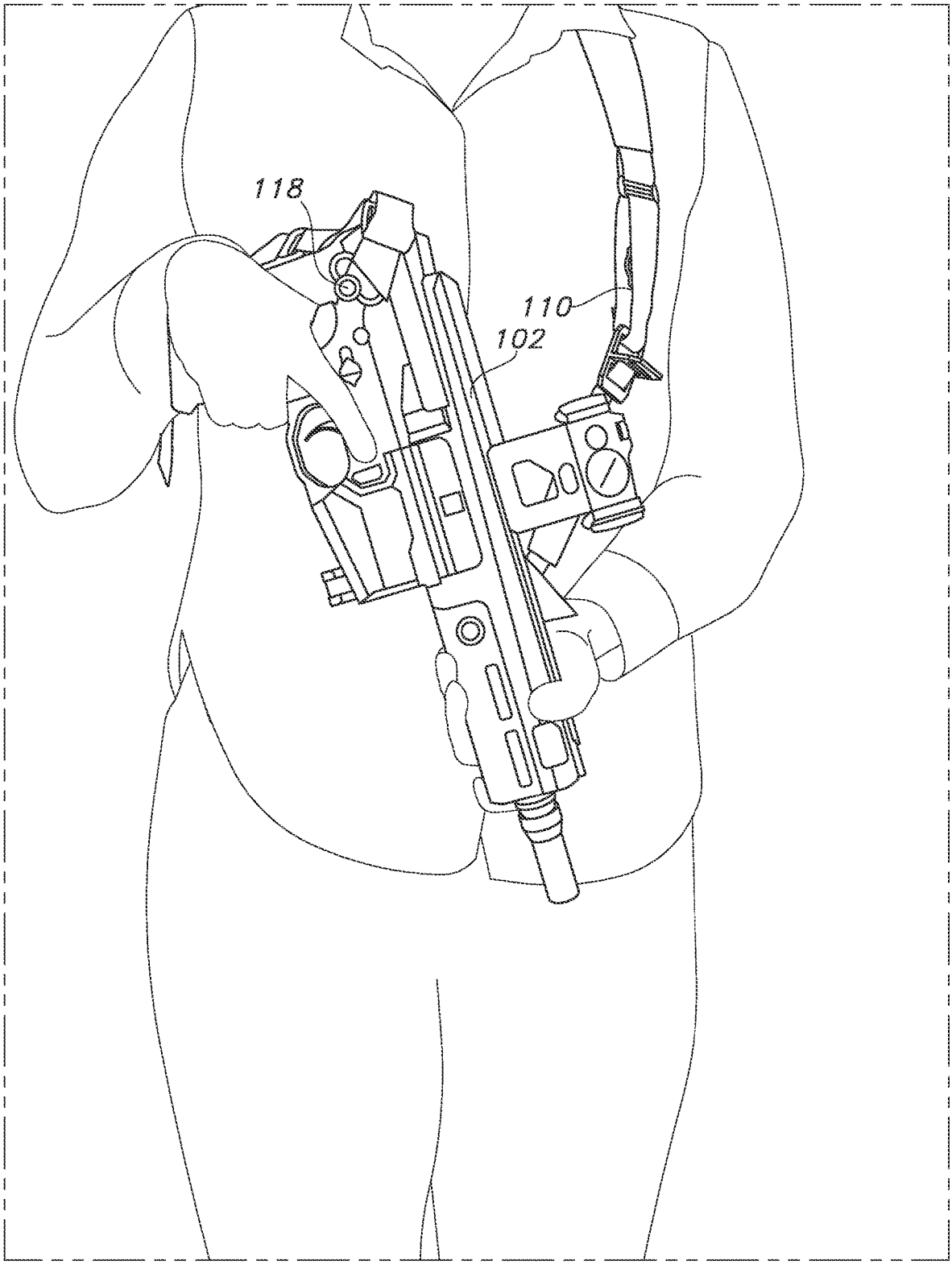
FIG. 7 is yet another side view of the sling system shown in FIG. 1 in use, wherein the user is shown holding the firearm after the release device has been used to detach the bag from the sling.

FIGS. 1-4 illustrate an example sling system 100 according to the principle of the present disclosure. The sling system 100 comprises a sling 110 used to carry a firearm 102 (e.g., a rifle), a bag 130 used to conceal the firearm 102 attached to the sling 110, and a release device 160 used to releasably attach the bag 130 to the sling 110. In this way, a user can discreetly transport the firearm 102 while maintaining the ability to rapidly deploy the firearm 102 by simply detaching the bag 130 concealing it (see, e.g., FIGS. 5-7).

Figure 8:
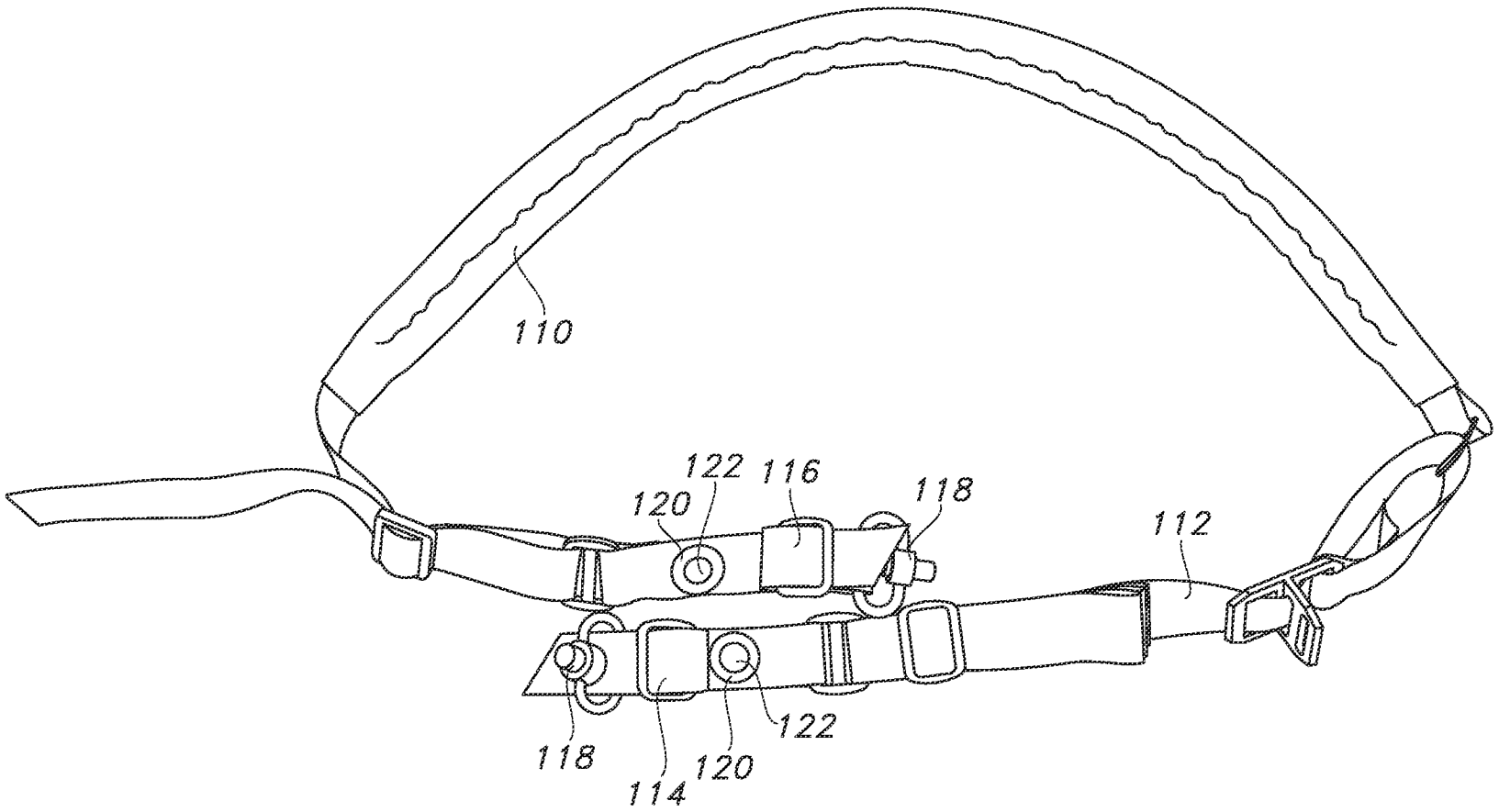
FIG. 8 illustrates the sling of the sling system shown in FIG. 1.

In the preferred implementation, but not limited thereto, the sling 110 is a two-point design that enables the wearer to position the attached firearm 102, and bag 130 if attached, in a variety of carry positions. As shown in FIG. 8, the sling 110 includes a strap 112 with an end 114 and an opposing end 116. The strap 112 is shaped as an elongated length of material. Each end 114, 116 of the strap 112 includes a connector 118 (e.g., a quick-detach (QD) sling swivel). Each connector 118 is capable of mounting to a corresponding connector found on the firearm 102 (see, e.g., FIG. 3). Adjacent each end 114, 116 of the sling 110 is a grommet 120 that defines an aperture 122, the purpose of which will be described in further detail below.

In the preferred implementation, but not limited thereto, the bag 130 is of a sling style, having a generally rectangular configuration with generally rounded corners. The bag 130 is formed by a front panel 132 and a back panel 134 that are interconnected by left and right side panels 136, 138 and a bottom panel 140 defining a storage compartment 142 for the firearm 102. As used herein, the term "front panel" refers to the panel that faces away from the wearer when the bag 130 is being worn and the term "back panel" refers to the panel that is worn against the wearer's body. The terms "left side" and "right side" refer to the side of the bag 130 with respect to the front panel 132.

Figure 9:
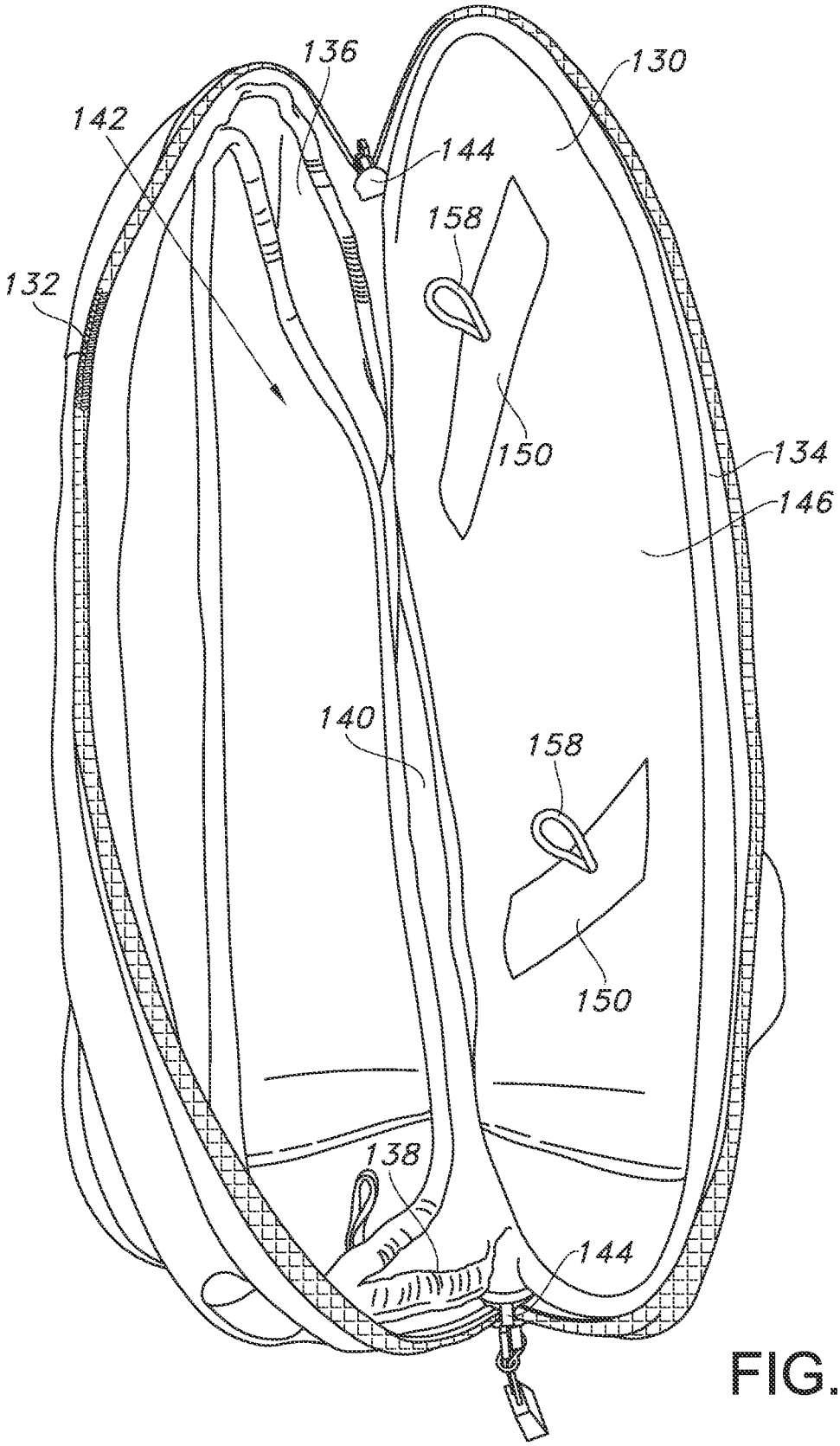
FIG. 9 illustrates the bag of the sling system shown in FIG. 1, wherein the interior of the storage compartment is shown.

The storage compartment 142 of the bag 130 can be substantially similar to any zippered storage compartment of a conventional sling style bag. For example, the left side panel 136 and the right side panel 138 can each be joined to the back panel 134 by a zipper closure 144. The interior surface 146 of the storage compartment 142 can be lined with a fastening component, as shown in FIG. 9. For example, the interior surface 146 of the storage compartment 142 can be covered by the loop or "pile" portion of a hook-and-loop fastener material.

As shown in FIG. 9, the sling system 100 also comprises two adapter panels 150 secured to the interior surface 146 of the storage compartment 142 defined by the bag 130. The adapter panels 150 are configured to be used in conjunction with the release device 160 to releasably attach the bag 130 to the sling 110 (see, e.g., FIG. 4).

Figure 10:
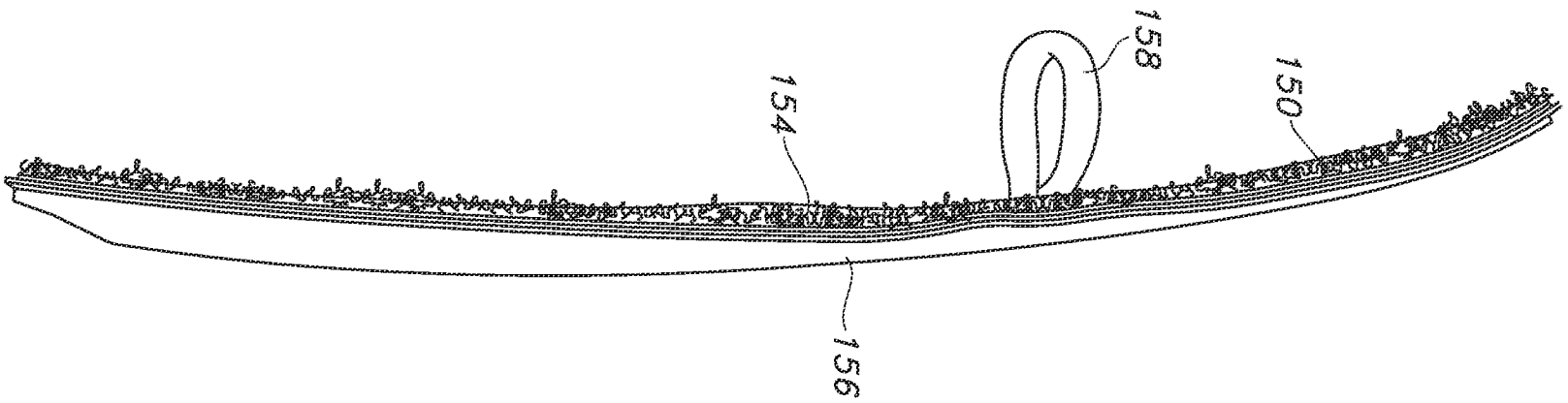
FIG. 10 is a side view of an adapter panel of the sling system shown in FIG. 1.

As shown in FIGS. 9 and 10, each adapter panel 150 includes a connection loop 158 configured to extend through an aperture 122 in the sling 110. The example connection loop 158 on each adapter panel 150 may comprise a flat or tubular webbing of a narrow width, such as ¼"/6 mm tubular webbing or gutted 550/650-spec parachute cordage (a.k.a. "para-cord"). In some implementations, a portion of the connection loop 158 is secured between two layers of flexible material joined together to form the adapter panel 150.

Each adapter panel 150 may be formed, such as by cutting, from a sheet of flexible material. Each adapter panel 150 has an outer surface 154, seen in FIG. 10, and a reverse surface 156 on the opposite side, which includes a fastener component. According to one implementation of the present invention, the fastener component is the hook portion of a hook-and-loop fastener material. However, it should be understood that the hook portion could be replaced with the loop or "pile" portion of a hook-and-loop fastener material in another implementation. One example material from which an adapter panel 150 can be formed from is VELCRO® brand ONE-WRAP® tape. Alternatively, other types of fasteners, such as snaps, may be provided on the reverse surface 156 of each adapter panel 150 and the interior surface 146 of the article (e.g., the bag 130) to which the sling 110 is to be attached. However, the use of hook-and-loop fastener material allows for a wide variety of placement options on the article to which the adapter panels 150 are to be attached. This allows the sling system 100 to be configured for use with a variety of PDW-style firearms.

In some implementations, the two connection loops 158 may be fixed in position, without the aid of adapter panels 150, within the storage compartment 142 of the bag 130.

Figure 11:
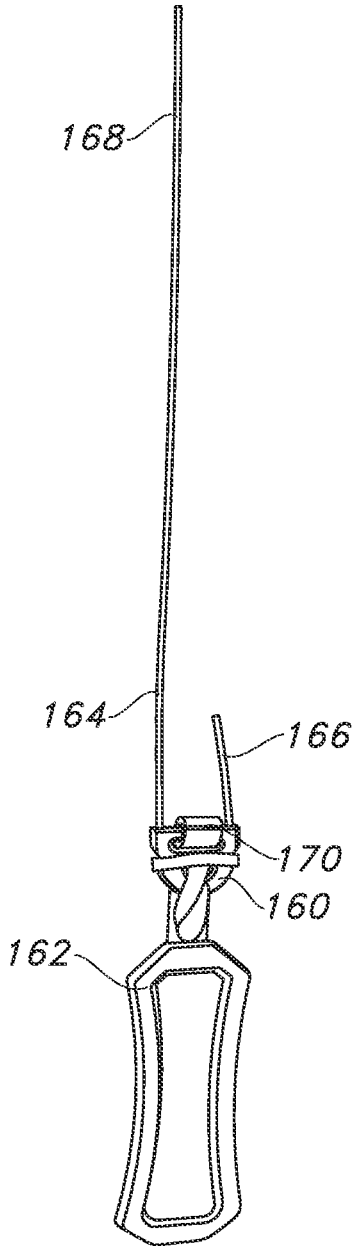
FIG. 11 illustrates the release device of the sling system shown in FIG. 1.

As shown in FIG. 11, the release device 160 comprises a pull tab 162 securely connected to a flexible elongate cable 164. The example cable 164 is a length of flexible nylon-coated stainless-steel cable. The cable 164 is shown as a single cable member having opposite end portions 166, 168 and an intermediate section 170 to which the pull tab 162 is secured. However, the cable 164 could be multiple pieces joined together.

Figure 1:
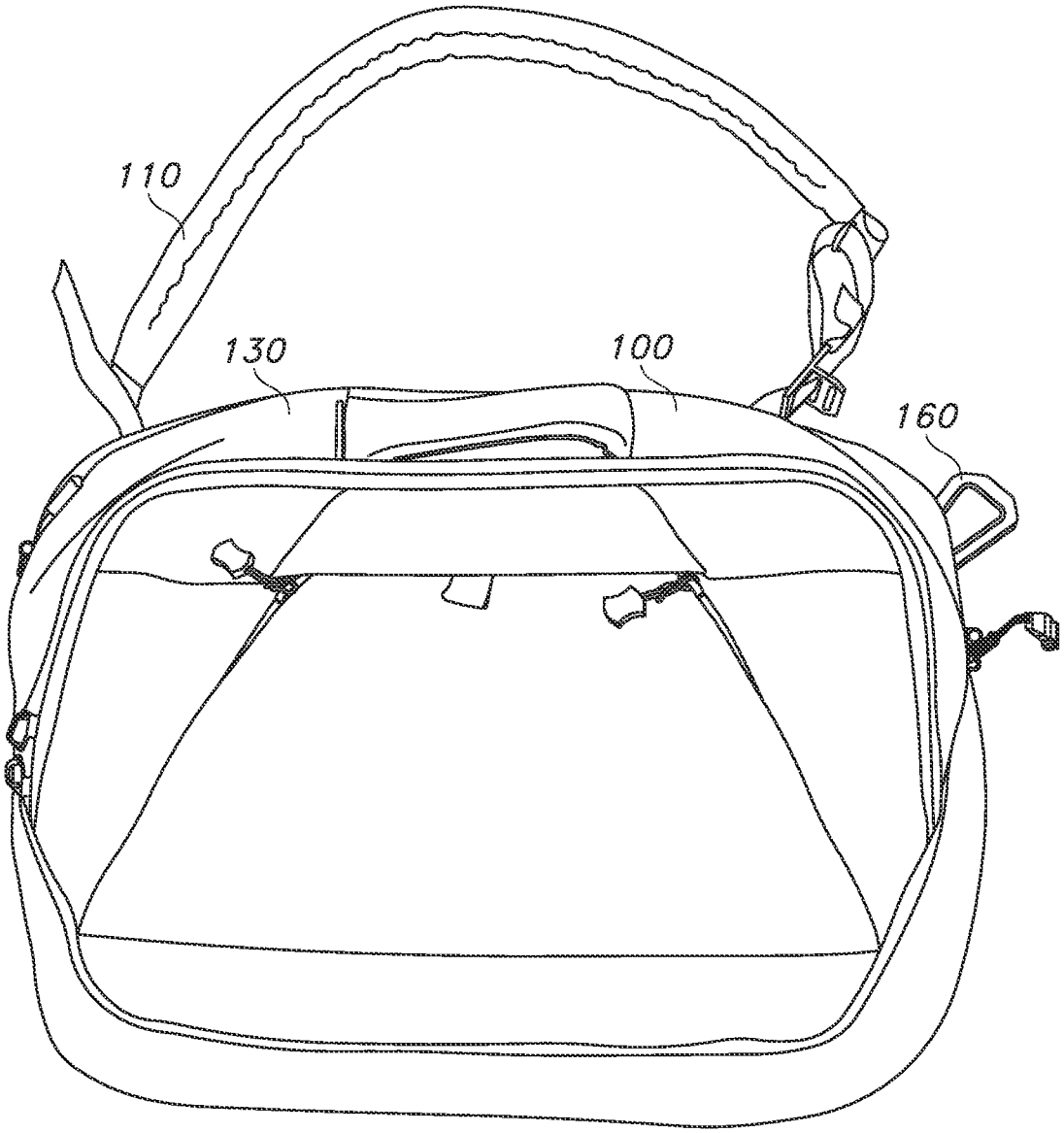
FIG. 1 is a front side view of an example sling system configured so that it can be used to carry and conceal a firearm.
Figure 2:
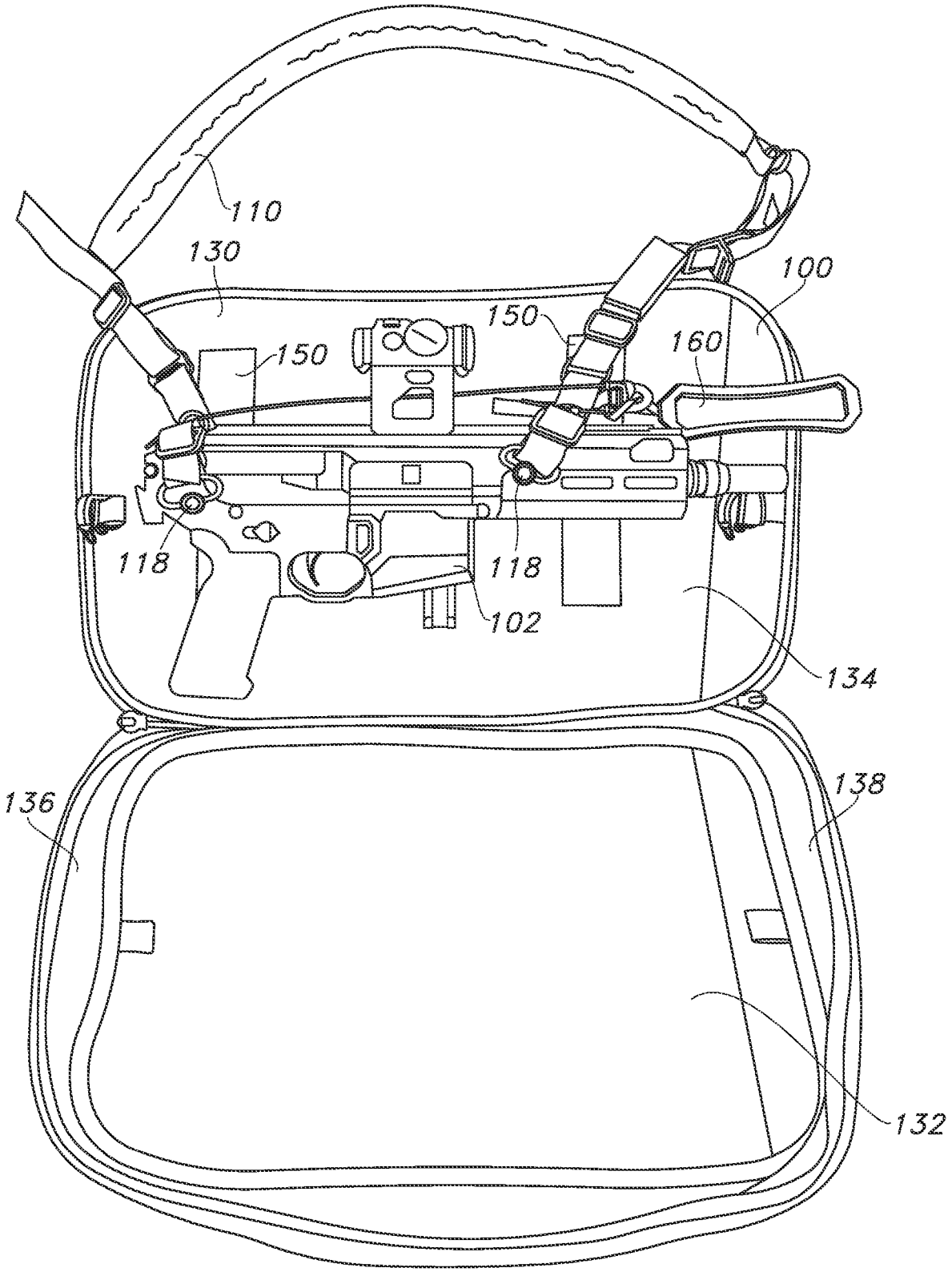
FIG. 2 is another front side view of the sling system shown in FIG. 1, wherein the bag is open exposing the firearm.
Figure 3:
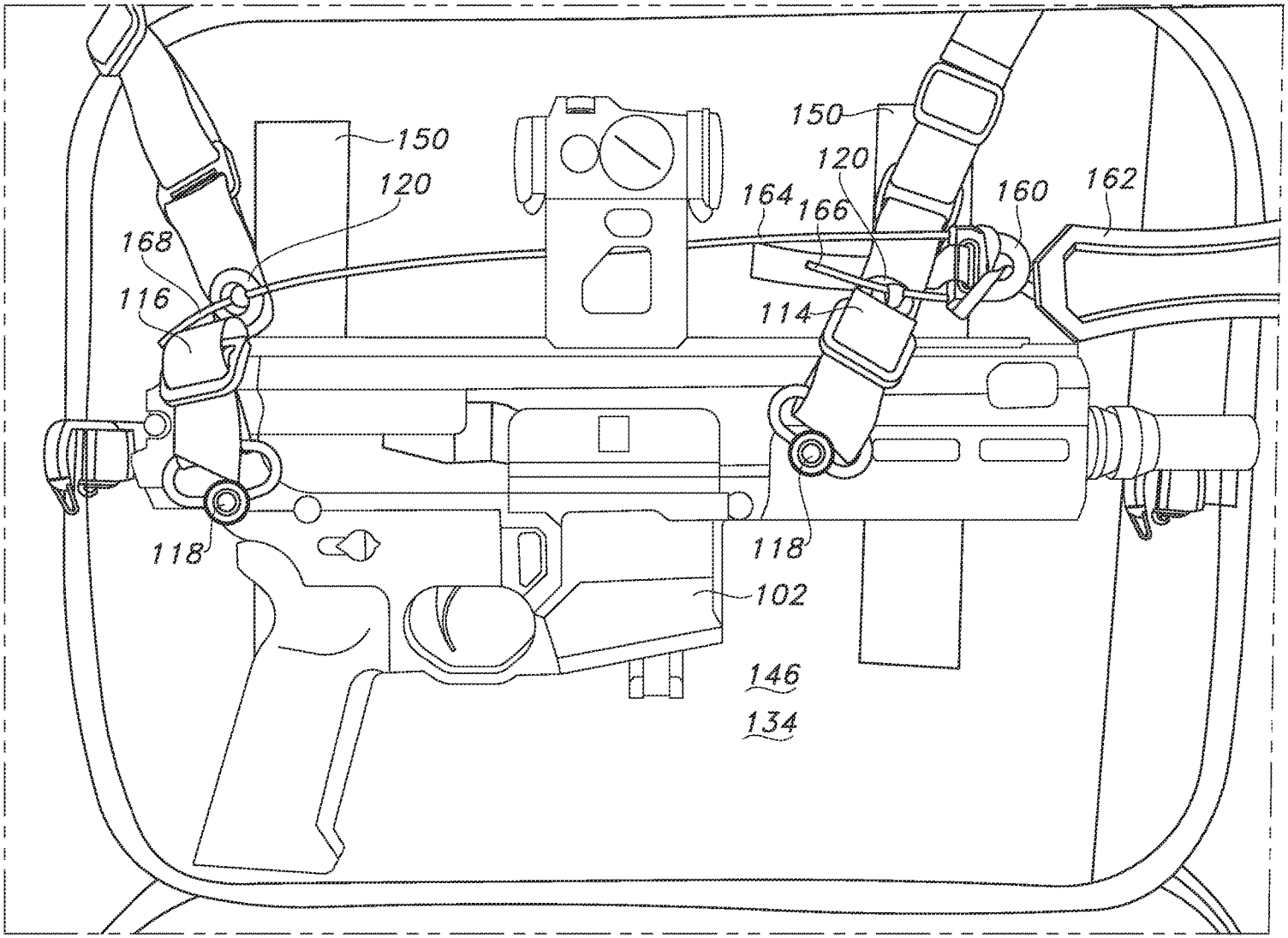
FIG. 3 is a close-up view of FIG. 2.
Figure 4:
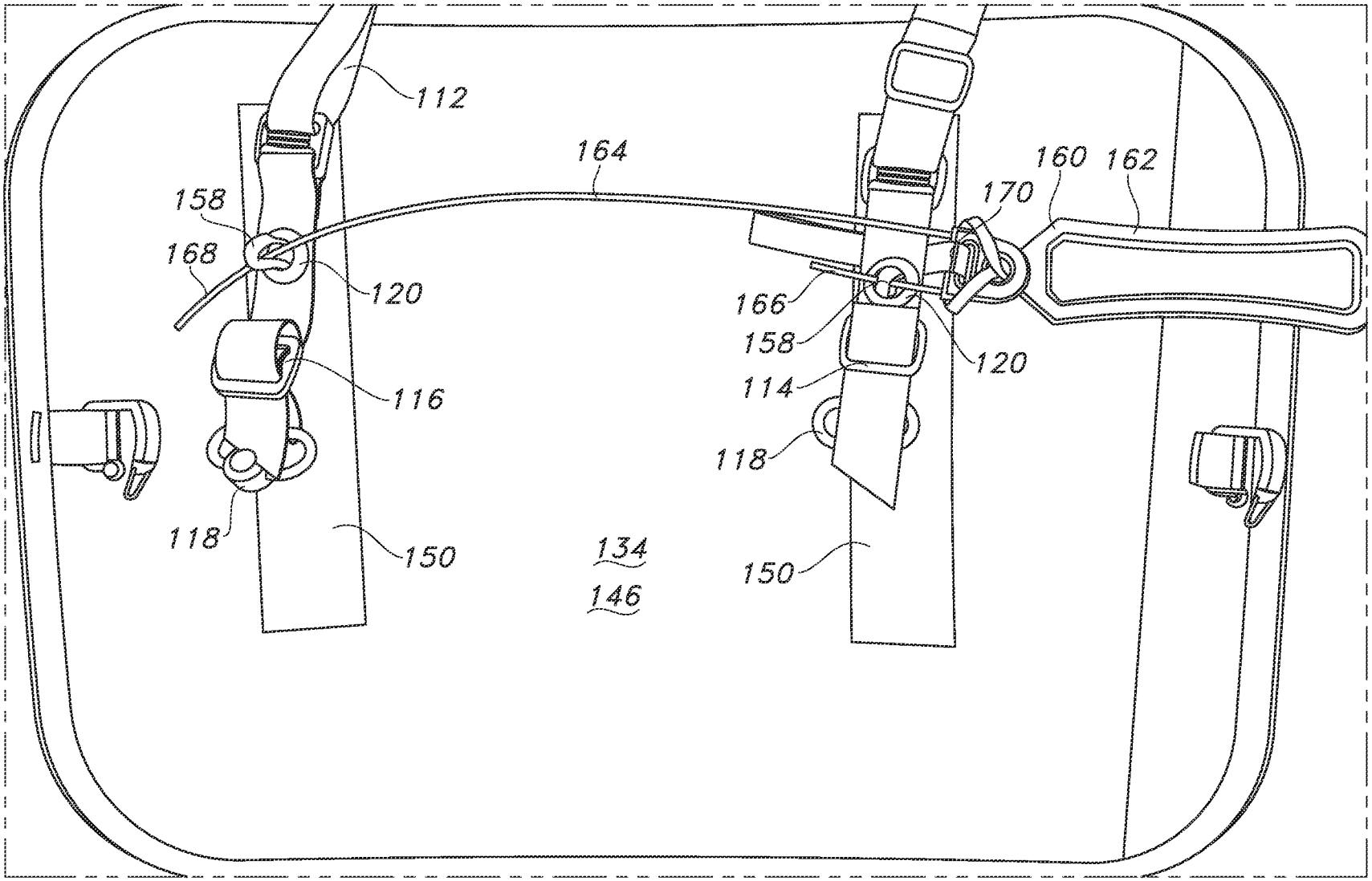
FIG. 4 is another close-up view of FIG. 2, wherein the firearm has been detached from the sling.

As best shown in FIG. 4, the release device 160 is used to attach the bag 130 to the sling 110 by passing each end portion 166, 168 of the cable 164 through one of the connection loops 158 extending through the grommet 120 adjacent each end 114, 116 of the sling 110.

The release device 160 is also used to detach the bag 130 from the sling 110. To detach the bag 130 from the sling 110, the pull tab 162 is used (i.e., pulled away from the bag 130 by the user) to withdraw each end portion 166, 168 of the cable 164 from its corresponding connection loop 158. Due to the weight of the bag 130, the connection loops 158 withdraw from the grommets 120 on the sling 110 and the bag 130 falls 130 away to reveal the firearm 102. The opening defined by each connection loop 158 is large enough to permit easy movement of the cable 164 through the opening. Also note, the end portions 166, 168 of the cable 164 are different lengths. Therefore, depending on the length of each end portion 166, 168, the release of the bag 130 from each end 114, 116 of the sling 110 is concurrent or, at least, substantially concurrent.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A sling system configured to carry and conceal a firearm, the sling system comprising:

a sling comprising a strap with a first end and a second end opposite the first end, the strap comprising a first aperture adjacent the first end and a second aperture adjacent the second end;

a bag comprising a storage compartment, the storage compartment comprising a first connection loop and a second connection loop positioned and configured to extend through the first aperture and the second aperture, respectively; and a release device comprising a pull tab and an elongate cable having a first end portion and a second end portion, the first end portion and the second end portion configured to work in conjunction with the first connection loop and the second connection loop, respectively, to releasably attach the bag to the sling.

2. The sling system of claim 1, wherein the strap comprises an elongate length of material.

3. The sling system of claim 1, wherein the strap includes a first connector on the first end and a second connector on the second end.

4. The sling system of claim 1, wherein the first aperture is defined by a first grommet and the second aperture is defined by a second grommet.

5. The sling system of claim 1, wherein the bag is a sling style bag.

6. The sling system of claim 5, wherein the storage compartment of the bag includes a first side panel and a second side panel, the first and second side panels being joined to a back panel by a zipper closure.

7. A sling system configured to carry and conceal a firearm, the sling system comprising:

a firearm sling;

a bag comprising a firearm storage compartment;

a first connection loop positioned within the firearm storage compartment;

a second connection loop positioned within the firearm storage compartment; and a release device configured to work in conjunction with the first connection loop and the second connection loop to attach the bag to the firearm sling, and further configured to detach the bag from the firearm sling when pulled.

8. The sling system of claim 7, wherein:

the firearm sling comprises a strap with a first end and a second end, and positioned adjacent the first end and the second end of the strap are a first aperture and a second aperture, respectively, in the firearm sling;

the first connection loop and the second connection loop are configured to extend through the first aperture and the second aperture, respectively, in the firearm sling; and the release device comprises a pull tab and an elongate cable having a first end portion and a second end portion, wherein the first end portion and the second end portion of the elongate cable are configured to extend through the first connection loop and the second connection loop, respectively, thereby releasably attaching the bag to the firearm sling.

9. The sling system of claim 8, wherein the strap comprises an elongate length of material.

10. The sling system of claim 8, wherein the strap includes a first connector on the first end and a second connector on the second end.

11. The sling system of claim 8, wherein the first aperture is defined by a first grommet and the second aperture is defined by a second grommet.

12. The sling system of claim 7, wherein the bag includes a front panel, a back panel, a left side panel, a right side panel, and a bottom panel.

13. The sling system of claim 12, wherein the front panel and the back panel are interconnected by the left side panel, the right side panel, and the bottom panel.

14. A sling system configured to carry and conceal a firearm, the sling system comprising:

a firearm sling;

a firearm bag comprising a storage compartment;

a first adapter panel;

a second adapter panel; and a release device configured to releasably attach the firearm bag to the firearm sling;

wherein:

the first adapter panel and the second adapter panel are positioned within the storage compartment of the firearm bag and configured to work in conjunction with the release device to releasably attach the firearm bag to the firearm sling; and the release device is configured to detach the firearm bag from the firearm sling when pulled.

15. The sling system of claim 14, wherein:

the firearm sling comprises a strap with a first end and a second end, and positioned adjacent the first end and the second end of the strap are a first aperture and a second aperture, respectively, in the firearm sling;

the first adapter panel and the second adapter panel each include a first connection loop and a second connection loop, respectively, each of the first and second connection loops positioned and configured to extend through the first aperture and the second aperture, respectively, in the firearm sling; and the release device comprises a pull tab and an elongate cable having a first end portion and a second end portion, each of the first and second end portions configured to extend through the first connection loop and the second connection loop, respectively, thereby releasably attaching the firearm bag to the firearm sling.

16. The sling system of claim 15, wherein the elongate cable comprises a length of flexible nylon-coated steel cable.

17. The sling system of claim 15, wherein the strap includes a first connector on the first end and a second connector on the second end.

18. The sling system of claim 15, wherein the first aperture is defined by a first grommet and the second aperture is defined by a second grommet.

19. The sling system of claim 14, wherein the firearm bag includes a front panel, a back panel, a left side panel, a right side panel, and a bottom panel.

20. The sling system of claim 19, wherein the front panel and the back panel are interconnected by the left side panel, the right side panel, and the bottom panel.

* * * * *